United States Patent [19]

Janoick et al.

[11] Patent Number: 4,792,049

[45] Date of Patent: Dec. 20, 1988

[54] SYSTEM AND PROCESS FOR SORTING AND CONVEYING ARTICLES

[75] Inventors: Dennis W. Janoick; John I. Schneider, both of Louisville, Ky.

[73] Assignee: Carrier Vibrating Equipment, Inc., Louisville, Ky.

[21] Appl. No.: 943,955

[22] Filed: Dec. 22, 1986

[51] Int. Cl.[4] ..... B07C 5/00

[52] U.S. Cl. ..... 209/556; 198/505; 209/586; 209/539; 209/920; 209/914; 209/934

[58] Field of Search ..... 209/539, 555, 556, 571, 209/586, 592, 598, 934, 920, 914, 936, 568, 930; 198/425, 505, 443, 609, 419

[56] References Cited

U.S. PATENT DOCUMENTS

| | | | |
|---|---|---|---|
| 3,028,947 | 4/1962 | Robertson | 198/609 |
| 3,118,512 | 1/1964 | Fishburne | 198/505 |
| 3,283,899 | 11/1966 | Vedvik et al. | 209/567 |
| 3,616,901 | 11/1971 | Groves | 209/555 |
| 3,895,716 | 7/1975 | Ugo | 209/567 |
| 4,004,693 | 1/1977 | Tsuji et al. | 209/555 |
| 4,586,612 | 5/1986 | Oberg | 209/555 |
| 4,586,613 | 5/1986 | Horii | 209/556 |
| 4,604,704 | 5/1986 | Eaves et al. | 209/586 |

FOREIGN PATENT DOCUMENTS

| | | | |
|---|---|---|---|
| 0057139 | 8/1982 | European Pat. Off. | 209/930 |
| 7341655 | 4/1976 | France | 198/505 |

*Primary Examiner*—Robert B. Reeves
*Assistant Examiner*—Donald T. Hajec
*Attorney, Agent, or Firm*—Jon C. Winger

[57] ABSTRACT

A system and process for sorting and conveying articles consisting of discarded tires and debris from one site to another site. The system and process receives articles in bulk, and concurrently singularizes and conveys the separated articles. Various physical characteristics of the individual articles, such as weight and size, are determined as the articles are continuously conveyed. Those articles having a physical property outside of a predetermined parameter range are ejected from the system. The remaining articles are then accumulated into groups of articles based on a physical characteristic of each article such that the sum of the physical characteristics of the articles of each group will be above a minimum and not exceed predetermined maximum values. The group of articles is then conveyed as a unit out of the system for a following operation such as disposal of the articles.

18 Claims, 5 Drawing Sheets

SYSTEM AND PROCESS FOR SORTING AND CONVEYING ARTICLES

BACKGROUND OF THE INVENTION

The present invention relates to article conveying and sorting systems, and more particularly, to a system and process for automatically singularizing bulked articles prior to conveying and sorting the articles according to a physical characteristic of the articles being conveyed, and grouping a number of articles together based on a physical characteristic of each article such that the sum of the physical characteristics of the articles of a group be greater than a predetermined minimum value and do not exceed a predetermined maximum value.

In our modern society, it has become a problem of how to dispose of discarded articles of manufacture in an efficient manner.

For example, a problem exists in disposing of billions of discarded motor vehicle tires. One way is to burn or incinerate the tires. Tires have a substantial energy content when incinerated. Therefore, it is economical to utilize the energy to generate usable power while at the same time disposing of these discarded tires. However, for safe and efficient operation of the incinerator, the incinerator must be charged with a predetermined controlled amount of fuel, in this case discarded tires. If the fuel charge is too great or too small, or contains foreign matter or debris, the efficiency of the incinerator is adversely affected and the incinerator could be damaged.

Thus, it is important that a constant supply of fuel, specifically discarded tires, be supplied to the incinerator in predetermined numbers and or weights making up a incinerator fuel charge within a range for efficient operation of the incinerator.

SUMMARY OF THE INVENTION

An object of the present invention is to provide a system and process for automatically sorting and conveying articles from one location to another.

Another object of the present invention is to provide a system and process for automatically singularizing and separating and directing bulked articles, sorting the separated articles, and conveying the articles to a destination based upon the requirements of the destination.

A further object of the present invention is to provide a system and process of the class described above which further accumulates the separated articles into groups of articles based upon a physical characteristic of the articles and demand of the process.

More particularly, the present invention provides an apparatus for transferring articles from a bulk storage area to a disposal site comprising vibrating bulk bin means for receiving the articles in bulk, a first vibrating conveyor located at the outlet of the bulk bin for receiving articles from the bulk bin, and concurrently singularizing, separating, and conveying the articles away from the bulk bin, a second conveyor located at the discharge of the first conveyor for receiving articles from the first conveyor and concurrently singularizing, separating, orienting, and conveying the articles away from the first conveyor, a third conveyor lcoated at the discharge of the second conveyor for receiviing articles one at a time from the second conveyor and conveying the articles in a file away from the second conveyor, means associated with the third conveyor for measuring various physical characteristics of each of the articles as they are being conveyed, means associated with the third conveyor for ejecting articles from the third conveyor which have physical characteristics outside of a predetermined range, a fourth conveyor located at the discharge of the third conveyor for receiving articles one at a time from the third conveyor and conveying the articles away from the third conveyor, an accumulator device located to receive articles one at a time from the fourth conveyor and accumulates the articles in groups based upon a physical characteristic of the articles.

BRIEF DESCRIPTION OF THE DRAWINGS

The objectives and features of the present invention will become even more clear upon reference to the following description in conjunction with the accompanying drawing wherein like numerals refer to like components throughout the several views and in which.

DETAILED DESCRIPTION OF THE PREFERRED EMBODIMENT

Figure 1:
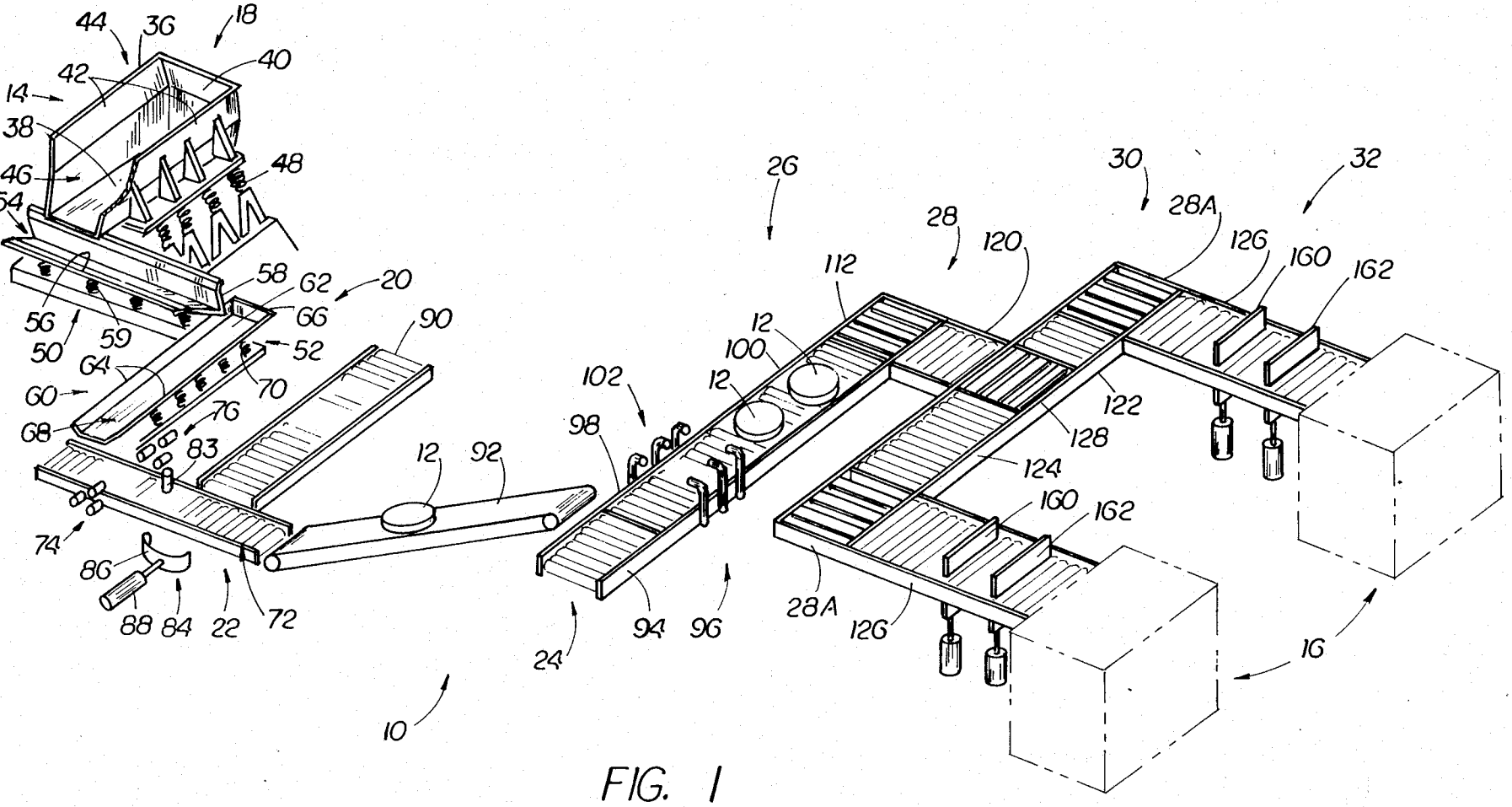
FIG. 1 is a schematic perspective view of the system of the present invention for sorting and conveying articles from one site to another site.

With reference to FIG. 1, there is illustrated a system, generally denoted as the numeral 10, for sorting and conveying articles 12 from one site 14 to another or delivery site 16. The system 10, as illustrated and discusssed hereinafter, is particularly well suited for sorting and conveying discarded vehicle tires 12.

There are a number of problems in attempting to convey and sort tires. Tires are of numerous different sizes (combination of different diameters and widths) and different weights. In addition, tires being manufactured of rubber are flexible and, therefore, tend to bounce during handling. Further, tires being toroidal in shape, smaller diameter tires tend to nest in the opening of larger diameter tires.

The system 10 is shown as including a tire receiving station, generally denoted as the 18, for receiving a bulk supply of tires and dispensisng the tires to be sorted and conveyed, a tire singularizing, orienting and separating station, generally denoted as the numeral 20, for receiving tires 12 to be sorted from the tire receiving station 18, and singularizing, orienting, separating and conveying the tires 12. A tire sorting station, generally denoted as the numeral 22, receives tires 12 from the separating station 20 and sorts the tires 12 based upon physical characteristics, ejecting those tires from the system which have such physical characteristics, such as weight or physical size, outside of a predetermined range. The system 10 further includes a tire conveying station, generally denoted as the numeral 24, for receiving the sorted tires from the sorting station 22 and conveying the tires in a single file away from the sorting station 22. A tire accumulation station, generally denoted as the numeral 26, receives tires 12 one at a time from the tire conveying station 24 and accumulates tires in groups based upon a physical characteristic of the tires. A tire group transport station, generally denoted as 28, receives groups of tires from the tire accumulation station 26 and transports the tire group to a tire group transfer station, generally denoted as 30. A tire group accumulation station, generally denoted as 32, receives tire groups from the tire group transfer station 30 and accumulates groups of tires for subsequent discharge from the system 10 in groups. For example, the groups of tires are discharged into an incinerator 16 as the fuel charge for the incinerator.

With continued reference to FIG. 1, the tire receiving station 18 is shown as a vibratory bulk bin 36. The vibratory bulk bin 36 has a floor 38, a back wall 40, and two side walls 42. The top 44 of the bin 36 is open for receiving a bulk supply of tires, and has a discharge opening 46 at one end defined between the terminating edges of the side walls 42 opposite the back wall 40. Preferably, the floor 38 is inclined from the back wall 40 toward the open discharge end 46. The bulk bin 36 is vibrated at a given stroke and frequency by virtually any known or convenient oscillating means (not shown) such as unbalanced rotating mass. For example, the bulk bin 36 is shown as being mounted on isolators, such as coil springs 48, and caused to oscillate by oscillating means. The particular various oscillating means are well known and will, therefore, not be further described. It has been found that the inclined floor 38 contributes to dispersing up the bulk load of tires as the tires move in the bin toward the open discharge end 46 so that the entire bulk load does not move as a unit or whole toward the open discharge end 46.

FIG. 1 shows the tire singularizing, orienting, separating and conveying station 20 as comprised of a first conveyor such as a vibratory conveyor 50 and a second conveyor such as a vibratory conveyor 52. The first vibratory conveyor 50 has an inverted V-shaped elongated conveying trough 54 formed of slanted intersecting side walls 56 and 58 which helps separate the tires being conveyed thereon. The conveying trough 54 is vibrated at a given stroke and frequency by virtually any known or convenient means. For example, the conveying trough 54 is shown as being mounted on isolators, such as coil springs 59, and caused to oscillate by oscillating means (not shown) such as an unbalanced rotating mass. The particulars of various oscillating means are well known and will, therefore, not be further described. The first vibratory conveyor 50 is vibrated at a higher frequency than is the bulk bin 36 so that the tires are moved in the bulk bin 36 to the open discharge end 46 at a lower velocity than that velocity at which the tires are moved along the first vibrating conveyor 50. For example, the tires in the bulk bin 36 move to the outlet end 46 at 5 feet per minute and the tires on the first vibrating conveyor 50 move therealong at 50 feet per minute. The first slanted wall 56 of the V-shaped trough is angled to the horizontal at a shallower angle than the second slanted wall 58 of the trough. The first vibrating conveyor 50 is located at and below the open discharge end 46 of the bulk bin 36 for receiving tires 12 therefrom. The longitudinal axis of the trough 54 is oriented perpendicularly to the direction of discharge of tires from the bulk bin 36. The face of the shallower angled first wall 56 faces toward the open discharge end 46 of the bin 36 so that the tires falling from the bin discharge end 46 into the trough 54 will tend to orient flat against the first wall 56 of the trough 54. The vibrations imparted to the trough 54 accomplishes a two-fold task. The imparted vibrations singularize and separate the tires in the trough 54 one from another, and also causes the tires to move along the trough 54 in the longitudinal direction thereof. The faster conveying velocity of the first conveyor 50 over the conveying velocity of the tires toward the discharge end 46 of the bin 36 also serves to prevent tires of stacking up in the conveyor trough 54 at the bin discharge end 46.

The second vibratory conveyor 52 has its inlet end located at and below the discharge end of the first vibratory conveyor 50 to receive tires 12 therefrom. The second vibratory conveyor 52 has a conveying trough 60 having a generally horizontal floor 62 with generally upright longitudinal side walls 64, one end wall 66 at the entrance end, and an open discharge end 68. The tires received from the first vibratory conveyor 50 lay flat on the trough floor 62 between the side walls 64. The conveying trough 60 is vibrated at a given frequency by virtually any known or convenient means. For example, the conveying trough 60 is shown as being mounted on isolators, such as coil springs 70, and is caused to oscillate by oscillating means (not shown) such as an unbalanced rotating mass. The particulars of various oscillating means are well known and will, therefore, not be further described. The second vibratory conveyor 52 is vibrated at a higher frequency than is the first vibratory conveyor 50 so that the tires are moved along the trough 60 of the second vibratory conveyor 52 at a higher velocity than the velocity at which the tires are moved along the trough 54 of the first vibratory conveyor 50. For example, tires on the first vibratory conveyor 50 move therealong at 50 feet per minute and the tires on the second vibratory conveyor 52 move therealong at 70 feet per minute. The vibrations imparted to the trough 60 of the second vibratory conveyor 52 further singularize and separate the tires received thereon, and causes the tires to move along the trough 60 in the longitudinal direction thereof. The faster tire conveying velocity of the second conveyor 52 over the tire conveying velocity of the first conveyor 50 serves to prevent tires of stacking up at the entrance to the second conveyor 52 as well as separate the tires from one another by a greater distance than the distance separating adjacent tires on the first conveyor 50.

Figure 2:
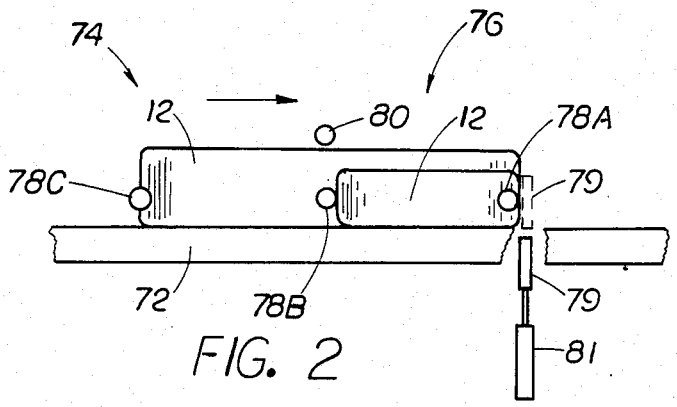
FIG. 2 is a schematic side view of a component of the system of FIG. 1.

With continued reference to FIGS. 1, the tire sorting station 22 is shown as including a third conveyor such as a powered roller conveyor 72 having an inlet end located at the discharge end of the second vibrating conveyor 52 for receiving tires 12 one at a time from the second vibrating conveyor 52. The sorting station 22 further includes first measuring means, generally denoted as the numeral 74, for measuring a physical characteristic of each tire, such as the outside diameter of the tire, and second measuring means, generally denoted as the numeral 76, for measuring another physical characteristic of each tire, such as the tire width which corresponds to the height the tire projects above the conveying surface. As shown in FIGS. 2, the first tire measuring means 74 includes spaced apart photoelectric cell devices 78 associated with the third conveyor 72. The photoelectric cell devices 78 are located a predetermined distance apart from each other, are symetrically located to either side of the longitudinal centerline of the third conveyor 72, and are aimed in a direction perpendicular to the direction of movement of the tires on the third conveyor 72. As shown, there are three photoelectric cell devices 78 A–C. The space between the downstream photoelectric cell device 78A and the middle photoelectric cell device 78B corresponds to the diameter of the smallest tire to be conveyed, and the space between the downstream photoelectric cell device 78A and upstream photoelectric cell device 78C corresponds to the diameter of the largest tire to be conveyed. Thusly, if a tire being conveyed on the third conveyor 72 only breaks the beam of the downstream photoelectric cell device 78A, but not the beams of the middle 78B and upstream photoelectric cell devices 78C, the tire is undersized in diameter. If the tire breaks the beam of the downstream photoelectric cell 78A and middle photoelectric cell 78B, the diameter of the tire will be between the minimum and maximum sized tires in diameter acceptable for further conveyance. If the tire breaks the beam of all three photoelectric cell devices 78 A–C, the tire is oversized in diameter. The tire should be stopped in order to make the above-discussed measurement. Toward this end, for example, movable gate device 79 is positioned in conveying path of the third powered-roller conveyor 72 immediately downstream of the downstream photoelectric cell device 78A. Alternatively, the gate device could be actuated by a pressure sensitive device which senses the presence of a tire positioned at the photoelectric cell 78A. The gate device 79 is movable between a lowered position (shown in solid lines in FIG. 2) below the conveying surface of the third conveyor 72 and a raised position (shown in phantom lines in FIG. 2) extending above the conveying surface of the third conveyor 72. Thus, when the gate device 79 is in the raised position, it contacts a tire 12 to be measured being conveyed on the conveying surface of the third conveyor 72 and stops further movement of the tire. The gate device 79 can be activated by various known devices such as, for example, a pneumatic cylinder device 81. The actuating device 81 is operatively associated with the downstream photoelectric cell device 78A so that when a tire breaks the photocell beam of the downstream photoelectric cell device 78A, it is actuated to move the gate device 79 to the raised position stopping further movement of the tire. After a timed interval sufficient for the measuring operation to be concluded, the gate device 79 is actuated to the lowered position allowing the tire to resume movement along the third conveyor 72.

Alternatively to using the gate device 79 to stop movement of the tire on the conveyor 72, it is contemplated that the photoelectric cell device 78A, or pressure sensitive device, can be operatively associated with the drive motor of the conveyor 72 to stop movement of the conveyor 72 itself when a tire is in position at the photoelectric cell device 78.

Alternatively to the three photoelectric cell devices 78 A–C, it is contemplated that the diameter of a tire can be determined using only one photoelectric cell device for example photoelectric cell 78A, and the elimination of the other photoelectric cell devices 78B and 78C and the gate device 79, by measuring the time required for a tire to pass through the blocked or interrupted beam of the photoelectric cell device 78A as the tire moves on the conveying surface of the third conveyor 72 at a constant known speed.

With continued reference to FIG. 2, the second tire measuring means 76 includes a photoelectric cell device 80 associated with the third conveyor 72 located a predetermined distance above the conveying surface of the third conveyor 72 and aimed in a horizontal direction or transversly across the direction of movement of the tires on the third conveyor 72. The space between the conveying surface of the third conveyor 72 and photoelectric cell device 80 corresponds to the maximum width of a tire to be conveyed through the system 10. If the tire breaks the beam of the photocell device 80, the tire is oversized in width for further conveyance.

Figure 3:
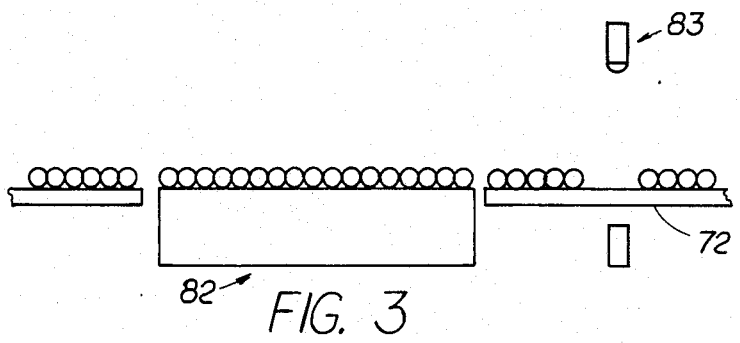
FIG. 3 is a schematic side view of another component of the system of FIG. 1.

With reference to FIG. 3, the sorting station 22 can optionally further includes a scale 82 located in the conveying path of the third conveyor 72. The scale 82 includes a top conveying surface such as, for example, rollers similar to the rollers of the third conveyor 72, or a belt conveyor section. The rollers of the scale 82 are in the plane of the rollers of the third conveyor 72 so as to provide a continuous, uninterrupted tire conveying path. Virtually any known scale can be used and, therefore, the scale 82 will not be further described in detail. The scale 82 can be used to detect foreign matter mixed with the tires being conveyed such as, for example, concrete, mud or water contained within the tires. Toward this objective, the scale 82 can be set to a predetermined weight corresponding to the maximum weight of a tire to be conveyed. A weight over the maximum will, thus, be detected by the scale indicating either an oversize tire or foreign matter included in an otherwise acceptable size tire.

With continued reference to FIG. 3, the sorting station 22 can even further include a detector means, generally denoted as the numeral 83, for detecting foreign material such as, for example, rims still mounted in the tires or foreign material intermixed among the tires. The rim detector means 83 can include a photoelectric cell device, for example, aimed in a vertical direction perpendicular to the direction of movement of the tires on the third conveyor 72 above the longitudinal centerline of the third conveyor 72. If a rim is still mounted in a tire, the beam of the photoelectric cell device 83 will be interrupted as the tire is positioned beneath the photoelectric cell device 83. Alternatively, the detector means 83 may be of any known type of metal detector, for example, one of the type which radiates a high frequency electromagnetic field and detects a change produced in that field by metal objects.

Referring again to FIG. 1, the sorting station 22 further includes tire ejecting means, generally denoted as the numeral 84, associated with the third conveyor 72 and located downstream of the tire measuring means 74 and 76, scale 82, and detector means 83. The tire ejecting means 84 is operatively associated with the first tire measuring means 74, the second tire measuring means 76, the detector means 83, and the tire weighing scale 82. As shown by way of illustration, the tire ejecting means 84 includes a tire pusher device located above the conveying surface of the third conveyor 72 oriented to selectively contact tires on the conveying surface and push the tires off the conveying surface. As illustrated, the tire pusher device includes a tire contact plate 86 attached to the operating rod of a fluid cylinder device 88. The fluid cylinder device 88 is oriented such that the operating rod moves back and forth transversely to the conveying path of the tires on the conveying surface of the third conveyor 72, thus, moving the tire contact plate 86 into and out of contact with the tires on the conveying surface. When either one of the first tire measuring means 74 or second tire measuring means 76 detects a tire having a dimension outside of a predetermined value, the ejecting means 84 is actuated causing the operating rod of the cylinder device 88 to extend forcing the contact plate against the tire having the out sized dimension and pushing that tire off of the conveyor 72. Similarly, when the scale 82 detects a tire weighing more than a preselected maximum, the ejecting means 84 is actuated causing the operating rod of the cylidner device 88 to extend forcing the contact plate 86 against the overweight tire and pushing that tire off of the third conveyor 72. Likewise, when the detector means 83 detects an object in, or mixed with the tires, the ejecting means 84 is actuated causing the operating rod of the cylinder device 88 to extend forcing the contact plate 86 against the metal object or tire containing a metal object pushing it off of the third conveyor 72.

A reject conveyor 90 can be located at the longitudinal side of the third conveyor 72 opposite the ejecting means 84 for receiving the ejected tires or metal objects to convey them to a location away from the third conveyor 72 for separate processing.

With continued reference to FIG. 1, the tire conveying station 24 is illustrated as including a fourth conveyor 92 and a fifth conveyor 94. The fourth conveyor 92 is shown as being an endless belt conveyor having an inlet end located at the discharge end of the third conveyor 72 for receiving tires within the predetermined size and weight range from the third conveyor 72 in single file orientation. Alternatively, for example, the fourth conveyor 92 could be an overhead chain and hook conveyor commonly referred to as a trolley type conveyor. The fourth conveyor 92 can be considered an optional feature, and has greatest utility in the system 10 in those installations having a substantial distance between the site between which the tires are to be conveyed or a different elevation between the sorting station 22 and tire accumulation station 26. Furthermore, it is contemplated that the fourth conveyor 92 be utilized to smooth out or regulate the flow of tires to the downstream tire accumulation station 26 so that the tire accumulation station 26 will receive a relatively constant supply of tires at a rate no faster or slower than that at which the accumulation station 26 can effectively operate. Toward this objective, it is contemplated that the fourth conveyor 92 can be selectively stopped and started and operated at variable conveying speeds so that if the tire accumulating station 26 is being over supplied with tires, the fourth conveyor can be stopped or operated at a decreased conveying speed, and conversely if the tire accumulating station 26 is being under supplied with tires, the fourth conveyor can be restarted or operated at an increased conveying speed. The fifth conveyor 94 can form a large closed loop, however, the fifth conveyor 94 is shown as a longitudinally extending conveyor located at the discharge end of the fourth conveyor 92 to receive tires one at a time and in single file from the fourth conveyor 92. As shown, the fifth conveyor 94 is located with its conveying path at an angle to the conveying path of the fourth conveyor 92 and is used, where necessary, to redirect the flow of the tires from the fourth conveyor 92 to the tire accumulation station 26. As shown, the fifth conveyor 94 is a powered roller conveyor having a conveying path horizontally at a right angle to the conveying path of the fourth conveyor 92.

Figure 4:
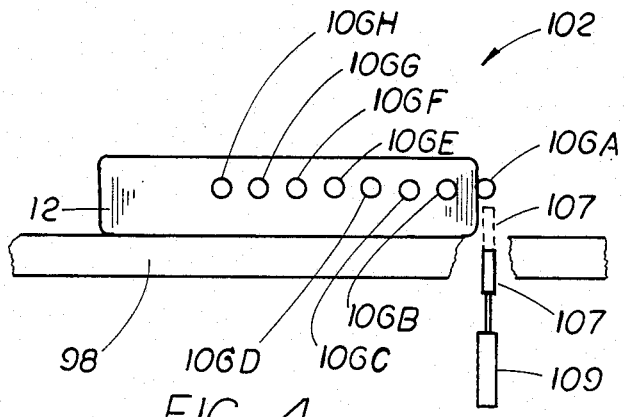
FIG. 4 is a schematic presentation of yet another component of the system of FIG. 1.

With continued reference to FIG. 1, the tire accumulation station 26 comprises a sixth conveyor 96 having its inlet located at the discharge of the fifth conveyor 94 for receiving tires therefrom one at a time in single file. The sixth conveyor 96 is formed of an upstream conveyor section 98 and a downstream conveyor section 100. The upstream conveyor section 98 and downstream section 100 are independently movable of each other. For example, the upstream conveyor section 98 can be a powered roller conveyor, and the downstream conveyor section 100 can be a separately powered roller conveyor. With reference to FIG. 1 and additional reference to FIG. 4, third tire measuring means 102 is associated with the upstream conveyor section 98 for measuring the outside diameter of the tires, being conveyed on the upstream conveyor section 98 in preparation for accumulating groups of tires on the downstream conveyor section 100. As shown, the third tire measuring means 102 includes a plurality of spaced apart photoelectric cell devices 106 A–H associated with the upstream conveyor section 98. The photoelectric cell devices 106 A–H are spaced apart along the conveyor path, at predetermined increments of, for example, three inches apart and are aimed in a direction perpendicular to the direction of movement of the tires on the upstream conveyor section 98. The direction of flow of the tires is indicated by the flow arrow in FIG. 4. As shown, the photoelectric cell devices 106 A–H are spaced apart at preselected intervals along the longitudinal axis of the conveyor path of the conveyor section 98. The distance between the upstream photoelectric cell device 106A and the downstream photoelectric cell device 106H corresponds to the difference in the diameters between the smallest diameter tire and largest diameter tire to be conveyed through the system 10. In order to accurately measure the diameter of a tire using the plurality photoelectric cell devices 106A–H, the tire must be stopped. Toward this objective, a movable gate device 107 is positioned in the conveying path of the conveyor section 98 downstream of the upstream most photoelectric cell device 106H by a predetermined distance corresponding to the diameter of the largest tire to be conveyed through the system 10. The gate device 107 is movable between a lowered position (shown in solid lines in FIG. 4) below the conveying surface of the conveyor section 98 and a raised position (shown in phantom lines in FIG. 3) extending above the conveying surface of the conveying path of the conveyor section 98. Thus, when the gate device 107 is in the raised position, it contacts a tire to be measured being conveyed on the conveying surface of the conveyor section 98 and stops further movement of the tire. The gate device 107 can be actuated by various known devices such as, for example, a pneumatic cylinder device 109. The actuating device 109 is operatively associated with the upstream photocell device 106A. When a tire to be measured breaks the photocell beam of the photoelectric cell device 106A the gate device 107 is actuated to move to the raised position stopping further movement of the tire. Thusly, the diameter of a tire stopped for measurement can be determined by the number of photocell beams interrupted by the tire. After a timed interval sufficient for the measuring operation to be concluded, the gate device 107 is actuated to the lowered position allowing the tire to resume movement along the conveyor section 98.

Alternatively to using the pluralilty of photoelectric cell devices 106A–H, it is contemplated that the diameter of a tire can be determined by the third tire diameter measuring means 102 using one photoelectric cell device, for example photoelectric cell device 106A, eliminating the gate device 107 and photoelectric cell device 106B–H, by measuring the time required for a tire to pass through the blocked or interrupted beam of the photoelectric cell device 106A as the tire continues to move on the conveying surface of the conveyor section 98 at a constant known speed. Thusly, as the tires move on the upstream conveyor section 98, the diamater of each tire is determined by the third tire measuring means 102.

The downstream conveyor section 100 is shown as being a powered roller conveyor and is independently driven from the upstream conveyor section 98. The function of the downstream conveyor section 100 is to accumulate tires in groups, the number of tires in each group being based upon a dimension of the tires, such as the diameter of the tires, as determined by the third measuring means 102 at the upstream conveyor section 98.

The third measuring means 102 is operatively associated with a programmed logic controller or computer 108 which is also operatively associated with the drive systems of the upstream conveyor section 98 and the downstream conveyor section 100. The program logic controller 108 is used to sum the diameter dimensions of the tires passing one at a time in single file on the upstream conveyor section 98. The third tire measuring means 102 signals the programmed logic controller 108 which sums or totals sequentially measured tires and monitors the positions of the tire moving on the upstream and downstream conveyor sections 98 and 100. When the sum of the tire diameters is between predetermined values indicating that a group of tires within a predetermined size range has been accumulated on the downstream conveyor section 100, the drive system of the downstream conveyor section 100 is actuated to move the group of tires from the downstream conveyor section 100 to the tire group transport section 28, and the drive system of the upstream conveyor section 98 is deactivated to stop the transfer of tires from the upstream conveyor section 98 to the downstream conveyor section 100. When downstream conveyor section 100 has transferred the tire group to the group transfer station 28, the downstream conveyor section 100 is deactivated and the upstream conveyor section 98 is reactivated to feed more tires to the downstream conveyor section 100 to make up another tire group.

Figure 5A:
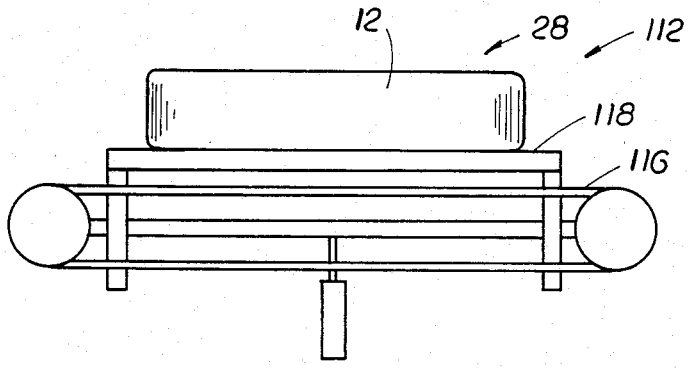
FIG. 5A and 5B are schematic presentation of still another component of the system of FIG. 1.
Figure 5B:
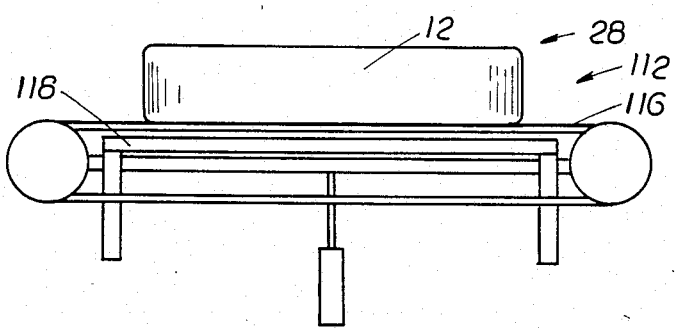

Now with reference to FIGS. 1, 5A and 5B, the tire group transport station 28 receives groups of tires from the downstream conveyor section 100. The tire group transport station 28 is used to transport the tire groups to the tire group transfer station 30. As shown, the tire groups at the transport station 28 must be reoriented to be properly received at the tire group transfer station 30. As shown, the tire group transport station 28 moves the group of tires in a direction at an angle, for example 90 degrees, to conveying direction of the downstream conveyor section 100 of the tire accumulation station 26. Toward this objective, the tire group transport station 28 comprises a conveyor section 112 located at the discharge end of the downstream conveyor section 100. Various mechanisms are known which are suitable for the conveyor transport section 112. For example, as shown in FIGS. 5A and 5B, the conveyor section 112 includes an endless drag chain conveyor 116 with the horizontal top chain flight oriented at 90 degrees to the conveying direction of the downstream conveyor section 100. The chain conveyor 116 is mounted in a suitable framework for movement in a vertical direction between a lowered position whereat the horizontal top chain flight is below the conveying surface of the downstream conveyor section 100 and a raised position whereat the horizontal top chain flight is above the conveying surface of the downstream conveyor section 100. The group transport station 28 further includes stationary horizontal bars 118 located in parallel with the top chain flights of the endless chain conveyor 116 located at the same elevation as conveying surface of the downstream conveyor section 100 of the fifth conveyor 96. In operation, groups of tires are received on the horizontal bars 118 of the group transport station 28 from the downstream conveyor section 100 with the chain conveyor 116 in the lowered position (see FIG. 5A). The chain conveyor 116 is then moved to the raised position lifting the tire group off the horizontal bars 118 with the tire group supported on the top chain flights of the chain conveyor 116 (see FIG. 5B). When in the raised position, the top flight of the conveyor 116 is at the elevation of the conveying surface of the tire group transfer station 30. The chain conveyor 116 is accuated thus moving the tire group to the tire group transfer station 30 in a direction 90 degrees to the direction of conveyance of the downstream conveyor section 100.

With reference to FIG. 1, the tire group transfer station 30 is used to transfer tire groups in different directions to different delivery sites, for example, to different incinerators 16. As shown, the tire group transfer station 30 includes, for example, a powered stem roller conveyor section 120 which receives tire groups from the group transport section 28. The transfer station 30 further includes a first powered branch roller conveyor section 122 and a second powered branch roller conveyor section 124. Both the first and second branch conveyor sections 122, 124 have their respective inlet ends in communication with the discharge end of the stem roller conveyor section 120, and extend in opposite direction therefrom. A tire group transport station 128, essentially identical to the tire group transport station 28 shown in FIGS. 5A and 5B, is located between the inlet ends of the first branch conveyor section 122 and the second branch conveyor 124 at the discharge end of the stem conveyor section 120 to redirect and move the tires from the stem conveyor section 120 to one or the other of the first branch conveyor section 122 and second branch conveyor section 124. The essential difference between the tire group transport station 128 and tire group transport station 28 is that the drive means of the tire group transport station 128 is reversible for driving the endless drag chain conveyor 116 selectively in either direction toward either the first branch conveyor section 122 or second branch conveyor section 124.

FIG. 1 shows two tire group accumulation stations 32. Each tire group accumulation station 32 receives groups of tires from a different one of the first and second branch conveyor sections 122 and 124, respectively. For the reason that the tire group accumulation stations 32 are identical, only one will be described for the sake of brevity. The tire group accumulation station 32 is shown as including an accumulation powered roller conveyor 126 having its inlet end at the discharge of the branch roller conveyor 122, 124 of the tire group transfer station 30 for receiving groups of tires therefrom. A tire group transport station 28A essentially identical to the tire group transport station 28 of FIGS. 5A and 5B is located between the discharge end of the branch conveyor 122, 124 and the inlet end of the accumulation conveyor 126 to redirect and move tires from the branch conveyor 122, 124 to the accumulation conveyor 126. The discharge end of the accumulation roller conveyor 126 is located at the disposal site or inlet to the incinerator 16. The tire group accumulation station 32 also includes means for controlling the discharge of tire groups from the conveyor 126 to the incinerator 16. The discharge control means includes a pair of spaced apart gates 160 and 162 located just downstream of the discharge of the roller conveyor 126. The gates 160 and 162 extend transversely across the conveying path of the roller conveyor 122 and are spaced apart from each other by a distance corresponding to the predetermined maximum diameter of tire 12 to be supplied to the incinerator 16. The gates 160 and 162 are located from the inlet to the roller conveyor 126 by a distance sufficient to receive and accumulate a plurality of tire groups on that portion of the roller conveyor 126 upstream of the gates 160 and 162. The gates 160 and 162 are movable in a vertical direction into and out of the conveying path of the roller conveyor 126 to selectively block the movement of the tire groups on the roller conveyor 126. In addition, the gates 160 and 162 are independently movable of one another. Various mechanisms for so moving the gates are known. In operation, the gate 160 is in the lowered position and the other gate 162 is in the raised position so that a tire group will move on the roller conveyor 126 into the area between the gates 160 and 162. The tire group moving into the space between the gates is stopped when it comes into abutting contact with the raised gate 162. The gate 160 is then raised to interfere with the movement of the succeeding tire group, and the gate 162 is lowered to allow the tire group between the gates 160 and 162 to resume movement on the roller conveyor 122 into the incinerator 16.

Figure 6:
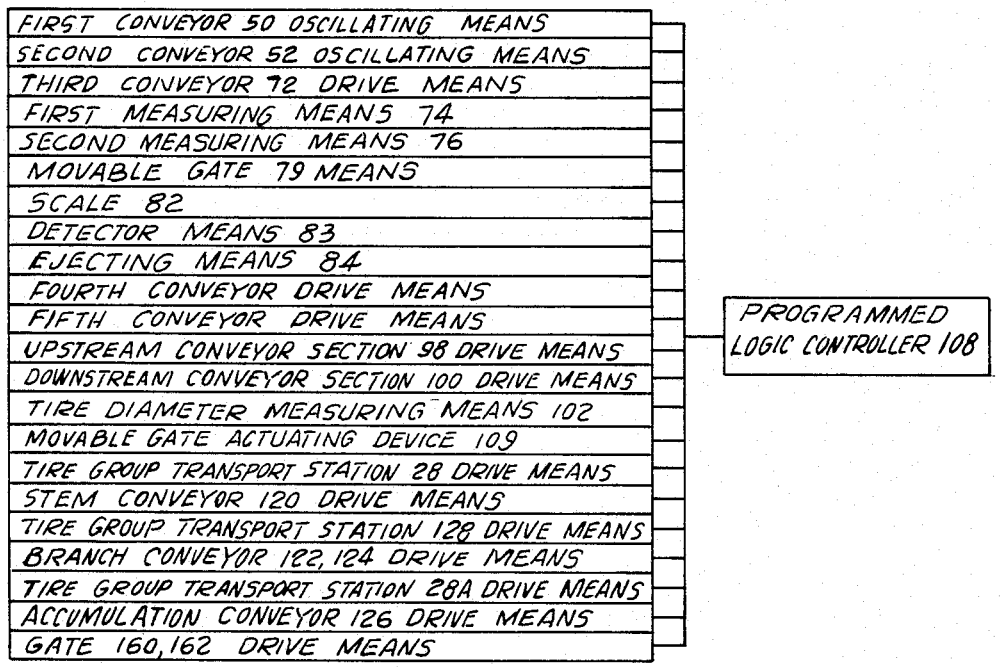
FIG. 6 is a schematic representation of a controller circuit for the sorting and conveying systems of the present invention.

With reference to FIG. 6, it is contemplated that the tire sorting and conveying system 10 will be controlled by programmed logic controller or computer 108. Toward this objective, the actuating means of the first conveyor 50, second vibrating conveyor 52, and third conveyor 72, the first measuring means 74, the second measuring means 76, movable gate 79, scale 82, detector means 83, ejecting means 84, drive means of the forth conveyor 92, drive means of the fifth conveyor 94, drive means of the upstream conveyor section 98, drive means of the downstream conveyor section 100, tire diameter measuring means 102, movable gate actuating device 109, drive means of the tire group transport station 28, drive means of the stem conveyor 120, drive means of the tire group transfer station 128, drive means of the two branch conveyors 122, 124, drive means of the tire group transport station 28A, and drive means of the accumulation conveyors 126, as well as the drive means for the gates 160, 162, are all operatively associated with the program logic controller 108.

In operation of the illustrated tire conveying and sorting system 10, if the first measuring means 74 or second measuring means 76 determines that a tire is undersized or oversized, the first 74 or second 76 measuring means signals the programmed logic controller 108. Likewise, if the scale 82 determines that a tire is overweight or if the detector means 84 determines that a rim is still in place in the tire, the scale 82 and detector means 84 signals the programmed logic controller 108. The programmed logic controller 108 monitors the speed of the third conveyor 72 and position of each tire on the third conveyor 72 and actuates the tire ejector means 84 when the out of specification tire is properly located at the ejector means 84 and rejected conveyor 90. The programmed logic controller 108 continuously monitors the position of each tire as it progresses from the ejector means 84 to the fourth conveyor 92, as well as the speed of the fourth conveyor 92 and position of each tire on the fourth conveyor 92. The programmed logic controller 108 can control the conveying speed of the first conveyor 50 and second conveyor 52 as well as the feed rate of the bulk bin 36 to prevent a build-up or jamming of tires in the system 10. This can be accomplished by, for example, information received by the programmed logic controller 108 from the first measuring means 74. For example, if the beams of the photoelectric cells 78 are blocked for a predetermined length of time corresponding to a tire build-up or accumulation at the first tire measuring means 74, the programmed logic controller 108 will either slow the conveying speed of the first vibratory conveyor 50 and second vibratory conveyor 52 or stop both of them and slow the feed rate of the bulk bin 36 until the tire build-up is eliminated as the third conveyor 72 continues to convey tires. As previously mentioned, the third tire measuring means 102 and to the drive means of the upstream conveyor section 98 and downstream conveyor section 100 are also operatively associated with the programmed logic controller 108. As the tires pass through the third tire measuring means 102 the information on the tire dimensions is stored in the logic controller 108. The programmed logic controller 108 sums the dimensions of the tires based on the information generated at the third tire measuring means 102 and controls the operation of the upstream conveyor section 98 and downstream conveyor section 100 to accumulate a properly sized group of tires on the downstream section 100. The programmed logic controller 108 actuates the tire group transport station 28 to move the tire groups to the tire group transport station 30. The programmed logic controller 108 monitoring the position of each tire also controls the actuation and conveying speed of the forth conveyor 92 and fifth conveyor 94 so that tires are fed to the sixth conveyor 96 at a steady rate without overloading or underloading the tire accumlation station 26. Likewise, the programmed logic controller 108 also controls the actuation of the stem conveyor 120, and tire group transfer station 128 to convey tire groups at a proper rate to one or the other of the branch conveyors 122 and 124 so that tire groups will not jam together on the stem conveyor 120 and the tire group transfer station 128, and will be directed to one or the other of the branch conveyors 122 and 124 to feed both accumulation conveyors 126 with a constant supply of tire groups. The programmed logic controller 108 further controls the actuation of the tire group transfer stations 28A to direct tire groups from the branch conveyor 122 and 124 to the accumulation conveyors 126 at a rate based upon the rate of conveyance of tires groups on the branch conveyors 122 and 124 to the group transfer station 28A and rate of conveyance of tire groups on the accumulation conveyors 126 away from the tire group transfer station 28A. The actuation and conveying speed of the branch conveyors 122 and 124 are also controlled by the programmed logic controller 108 so that the tire group transfer station 28A will not be jammed with tire groups. Similarly, the actuation and conveying speed of the accumulation conveyors 126 are controlled by the programmed logic controller 108 so that the control gates 160 and 162 will be supplied with tire groups at an appropriate rate and will not be jammed with tire groups.

The programmed logic controller 108 can also use the weight data received from the scale 82 and tire location data received from the first measuring means 74 to control the conveying rate of at least the accumulation conveyors 126 and gates 160, 162, so that the incinator 16 will be supplied with tire groups within a predetermined weight range and at a relatively constant rate. The energy content per pound of tire material would be first determined and stored in the programmed logic controller 108. A sensor at the incinerator 16 would monitor the energy output of the incinerator 16 and send this information to the programmed logic controller 108. In addition, a predetermined target value of energy output from the incinerator 16 would be stored in the programmed logic controller 108. As the energy output from the incinerator 16 would vary over or under the predetermined target value as monitored by the programmed logic controller 108, the programmed logic controller 108 would decrease or increase, respectively, the conveying rate of the accumulation conveyors 126 based upon the energy content of the tires being conveyed thereon so that the incinerators will be supplied with less or more fuel as required to maintain the target energy output value.

With continued reference to FIG. 1, it is further contemplated that the third tire measuring means 102 could be eliminated and that the programmed logic controller 108 be used to continuously monitor the position of each measured tire being transported on the system 10 downstream of the tire ejection means 84 and to control the operation of all of the various components of the tire conveying station 24, tire accumlation station 26, tire transport stations 28 and 128, tire group transfer station 30, and tire group accumulation station 32. The sizes of the tires determined at the first measuring means 74 and second measuring means 76 and data on the location or position of each tire at the first and/or second measuring means would be stored in the programmed logic controller 108. Therefore, the programmed logic controller 108 can be used to control the operation of all of the components of the system 10 based upon the information received from the first 74 and second 76 measuring means and stored in the programmed logic controller 108.

Figure 7:
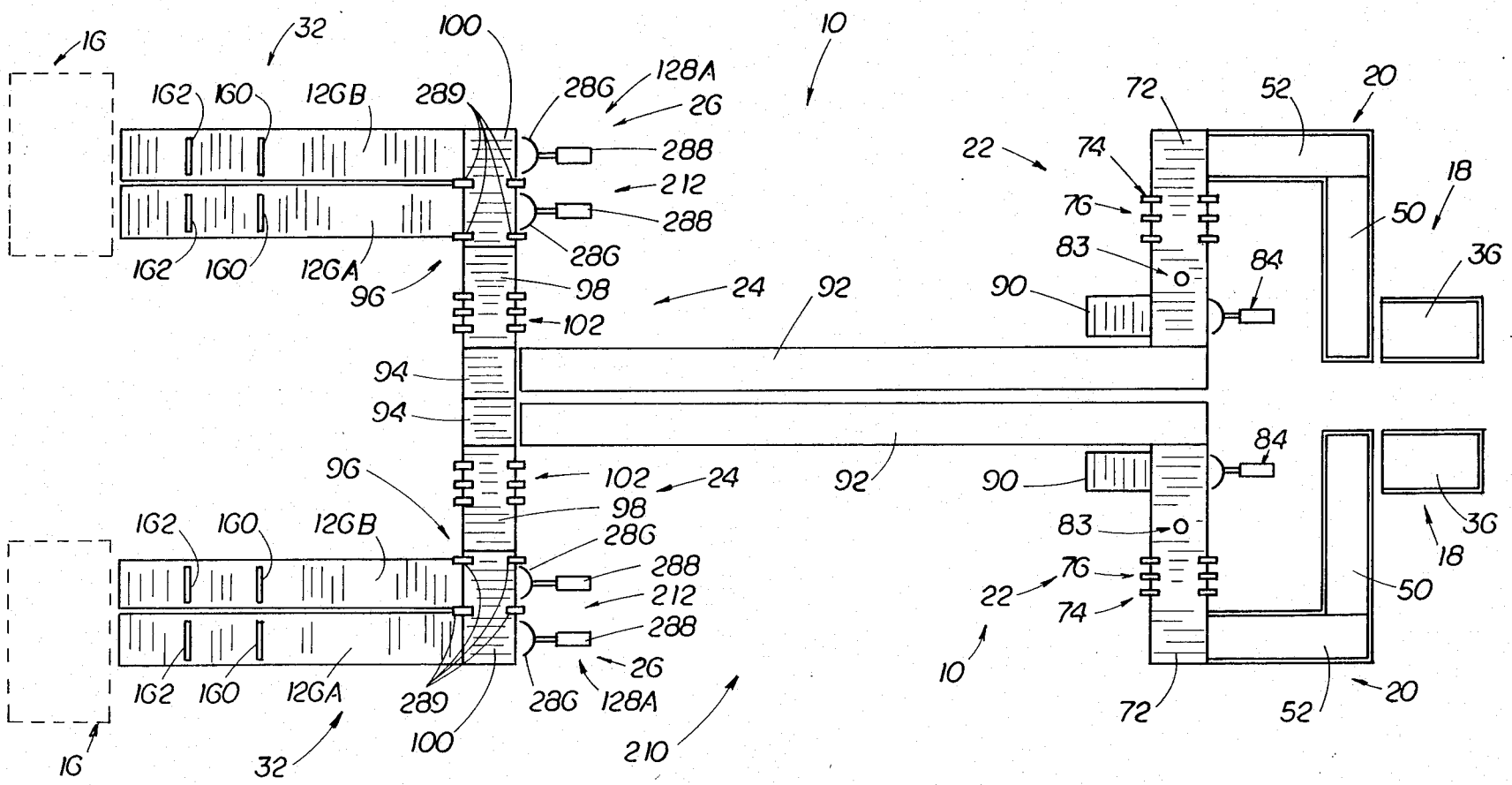
FIG. 7 is a schematic plan view of another embodiment of the sorting and conveying system of the present invention.

FIG. 7 illustrates in plan view another embodiment of a sorting and conveying system, generally denoted as the numeral 210, which has many components and features in common with the sorting and conveying system 10 of FIG. 1. For the sake of brevity, these common features and components are denoted by like numerals in FIG. 7, and a description of them will not be repeated.

The sorting and conveying system 210 essentially comprises two sorting and conveying systems 10 in side-by-side mirrored relationship, and can be used for supplying tires at a greater volume than a single system 10. Thus, the embodiment of FIG. 7 illustrates the versatility of the present invention.

In comparing the system 210 illustrated in FIG. 7 with the system 10 illustrated in FIG. 1, the tire group transport station 28 at the downstream end of the downstream conveyor section 100 of the sixth conveyor 96 as well as the tire group transfer station 30 have been eliminated so that the downstream section 100 of the sixth conveyor 96 feeds directly to a tire group transport station 128A at the inlet end of the accumulation conveyors 126 of the tire group accumulation stations 32. The tire group accumulation stations 32 have each been modified by the use of two parallel accumulation conveyors 126A and 126B feeding a single site or incinerator 16.

In addition, the tire group transport station 128A is shown as including tire pusher means 212 in place of the transport conveyor section 112 with its endless drag chain conveyor 116 and stationary horizontal bars 118 of the tire group transport station 28A of the system 10 shown in FIG. 1. As shown in FIG. 7, the tire pusher means 212 of each of the tire groups transport stations 128A comprises a pair of side-by-side tire contact plates 286 at the downstream end of the downstream conveyor section 100 of the sixth conveyor 96 with each one of the tire contact plates 286 in alignment with a different one of the parallel accumulation conveyors 126A and 126B transversely across the downstream conveyor section 100. Each contact plate 286 is attached to the operating rod of a different fluid cylinder device 288. The fluid cylinder devices 288 are each oriented such that the operating rods move back and forth transversely to the conveying path of the tires on the downstream conveyor section 100 and in the direction of the conveying path of a different one of the accumulation conveyors 126A and 126B for moving the tires from the downstream conveyor section 100 to a selected one of the accumulation conveyors 126A and 126B. Toward this objective, the tire group transport stations 128A can include photoelectric cell devices 289 located just upstream of each of the tire contact plates 286 of the tire group transport station 128A operatively interconnected with the fluid cylinder devices 288. Alternatively, the photoelectric cell device 289 can be eliminated and the fluid cylinder device 288 can be operatively associated with the programmed logic controller 108. The programmed logic controller 108 continuously monitors the position of the tire groups and actuates the fluid cylinder devices 288 of tire group transfer station 128A when a tire group is properly located at the entrance end of one or the other of the accumulation conveyors 126A or 126B.

Furthermore, each of the accumulation conveyors 126A and 126B also includes the gates 160 and 162.

With continued reference to FIG. 7, it is further contemplated that the third tire measuring means 102 and photoelectric cell 289 could be eliminated and that the programmed logic controller 108 be used to continuously monitor the position of each measured tire being transported on the system 210 downstream of the tire ejection means 84 and to control the operation of all of the various components of the tire conveying station 24, tire accumulation station 26, tire group transport station 128A, and tire group accumulation station 32. The sizes of the tires determined at the first measuring means 74 and second measuring means 76 and data on the location of each tire at the first and/or second measuring means would be stored in the programmed logic controller 108 as would the positions of the measured tires. Therefore, the programmed logic controller 108 can be used to control the operation of all of the components of the system 210 based upon the information received from the first and second measuring means and stored in the programmed logic controller 108.

Figure 8:
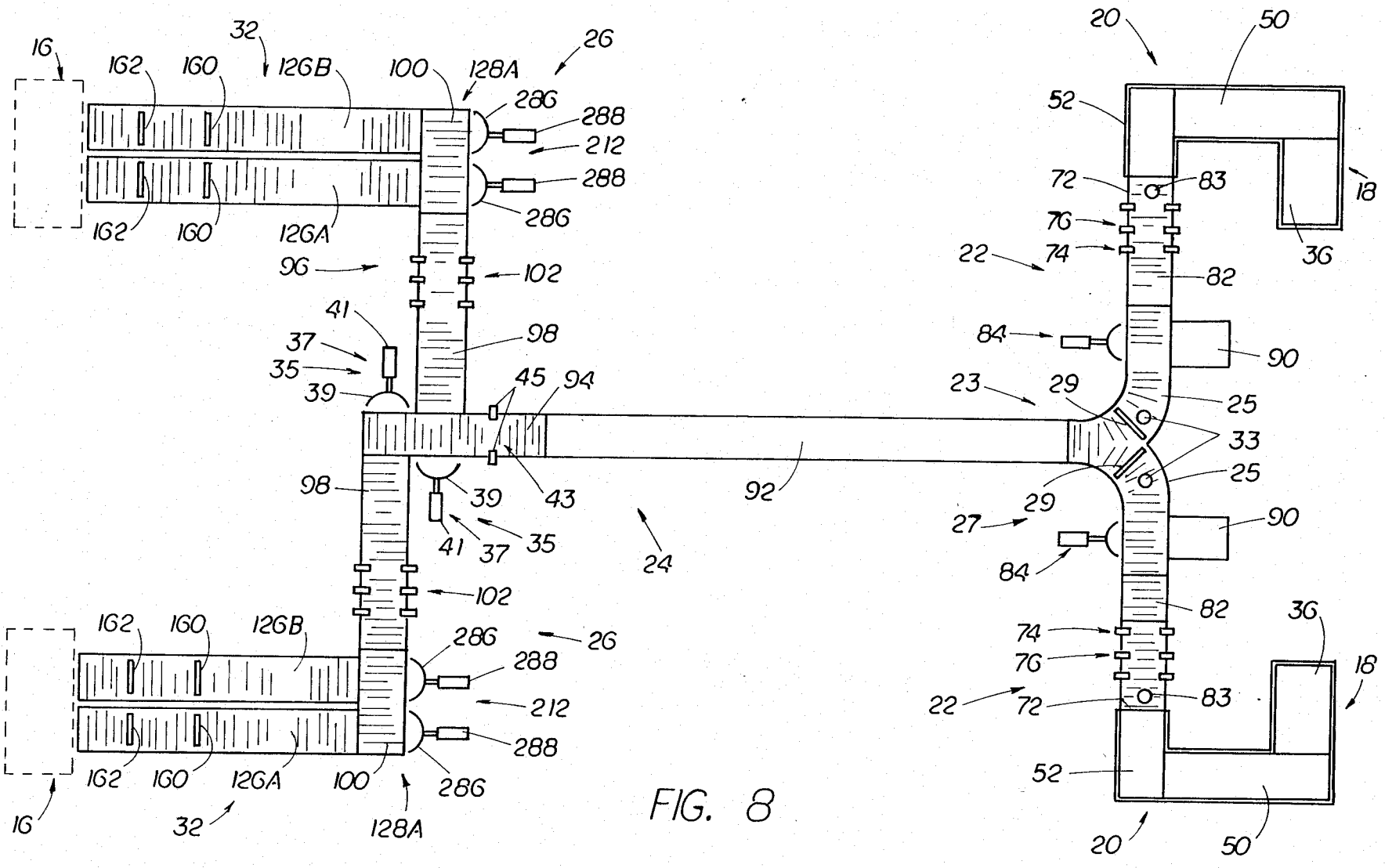
FIG. 8 is a schematic plan view of yet another embodiment of the sorting and conveying system of the present invention.

FIG. 8 illustrates in plan view yet another embodiment of a tire sorting and conveying system, generally denoted as the numeral 310, which includes many of the same components of the tire sorting and conveying system 10 of FIG. 1 and system 210 of FIG. 7. For the sake of brevity, the common components are denoted by identical numerals in all of the figures, and the description thereof will not be repeated.

The tire sorting and conveying system 310 includes two tire receiving stations 18, two tire singularizing, orienting and separating stations 20, and two tire sorting stations 22 located symetrically to either side of and feeding tires to a single fourth conveyor 92.

Figure 9:
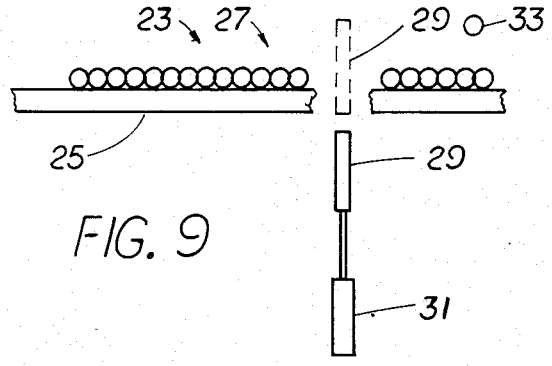
FIG. 9 is a schematic side view of a component of the system of FIG. 8.

A tire switching section 23 is located at the intersection of the two third powered conveyors 72 of the two tire sorting stations 22 and the inlet or upstream end of the fourth conveyor 92. The tire switching section 23 is used to control the flow of tires from the two tire sorting stations 22 to fourth conveyor 92. As shown by way of example, the tire switching section 23 includes two curved merging roller conveyors 25 which extend from the outlet or downstream end of the third conveyors 72 of the two tire sorting stations 22 and merge at the inlet or downstream end of the fourth conveyor 92. The flow of tires from each of the curved conveyors 25 onto the fourth conveyor 92 is controlled by traffic control means 27 so that tires flowing onto the fourth conveyor 92 from the curved conveyors 25 will not interfere with each other. The traffic control means can include, for example, a movable gate device 29 positioned in each of the curved conveyors 25 upstream of their location of merger for selectively preventing and allowing a tire to move along the curved conveyors 25. The gate device 29 can be movable between a lowered position (shown in solid lines in FIG. 9) below the conveying surface of the curved conveyor 25 and a raised position (shown in phantom lines in FIG. 9) extending above the conveying surface of the curved conveyor 25. Thus, when the gate device 29 is in the raised position, it contacts a tire being conveyed on the curved conveyor 25 and stops further movement of the tire. The gate device 29 can be actuated by various known devices such as, for example, a pneumatic cylinder device 31. The gate actuating devices 31 are operated by means of, for example, photoelectric cell devices 33 located at each of the curved conveyors 25 just upstream of the merger of the curved conveyors 25 to direct a beam across the conveying surface of the curved conveyor. The photoelectric cell device 33 in each curved conveyor 25 is operatively associated with the actuating device 31 of the gate device 29 in the other curved conveyor 25 so that when a tire on one curved conveyor 25 breaks the photocell beam of the photoelectric cell 33 associated with that curved conveyor 25, the gate device 29 of the other curved conveyor 25 is raised to stop a tire moving on the other curved conveyor 25. After the tire moves through the photocell beam and is on the merged section, the gate device 29 of the other curved conveyor 25 is lowered so that the stopped tire will resume movement onto the merged section. Alternatively, the photoelectric cell devices 33 can be eliminated and the gate actuating devices 31 can be operatively associated with the programmed logic controller 108 which continuously monitors the position of all of the tires and actuates one or the other of the gate actuating devices 31 according to the positon of tires on each curved conveyor 25. As another alternative, it is contemplated that the gate devices 29 can be eliminated and the photoelectric cell devices 33 can be operatively associated with the drive of the conveyors 25 to stop and start the conveyors 25 to effect traffic control. The fifth conveyor 94 is longitudinally aligned with the downstream or outlet end of the fourth conveyor 92 to receive tires therefrom. The fifth conveyor 94 functions as a tire accumulation conveyor.

The system 310 further includes two tire group accumulation stations 26 located symetrically at the discharge or outlet end of, and to either side of the fifth conveyor 94 for receiving tires from the fifth conveyor. Each tire group accumulation station 26 includes a sixth conveyor 96 having its inlet located at the discharge or outlet end of the fifth conveyor 94 for receiving tires therefrom one at a time in single file. The sixth conveyor 96 can be, for example, a powered roller conveyor.

In addition, the fifth conveyor 94, is also shown as including two tire transfer stations 35 for transferring tires from the fifth conveyor 94 to one or the other of the two sixth conveyors 96 of the tire accumulation stations 26. As shown each tire transfer station 35 includes tire pusher means 37 located in alignment with the sixth conveyors 96 of that tire transfer stations 35 to pus selected tires from the fifth conveyor 94 on to one or the other of the sixth conveyors 96 of the accumulation stations 26. Toward this objective, each tire pusher means 37 includes a tire contact plate 39 located to the opposite longitudinal side of the fifth conveyor 94 from the sixth conveyor 96. Each contact plate 39 is attached to the operating rod of a fluid cylinder device 41. The fluid cylinder device 41 is oriented such that the operating rod moves back and forth transversely of the conveying path of the tires on the fifth conveyor 94 in alignment with and in the direction of the conveying path of the sixth conveyor 96 for moving the tires from the fifth conveyor 94 to the sixth conveyor 96. The tire transfer stations 35 are selectively operated to move the tires from the fifth conveyor 94 to a selected one of the sixth conveyors 96 of one or the other of the two tire group accumulation stations 26. Toward this objective, tire measuring means, generally denoted as the numeral 43, is located at the fifth conveyor 94 upstream of the tire pusher means 37 for measuring the diameter of each tire moving on the fifth conveyor 94 toward the tire pusher means 37. The fourth tire measuring means 43 is shown as including at least one photoelectric cell device 45 oriented to direct the photocell beam transversely across the conveying path of the fifth conveyor 94. The diameter of a tire is determined by measuring the time required for a tire to pass through the blocked or interrupted beam of the photoelectric cell device 45 as the tire moves on the conveying surface of the fifth conveyor 94 at a constant speed. The photoelectric cell device 45 is operatively associated with the tire pusher means 37, to actuate the fluid cylinder device 41 of one or the other of the tire pusher means 37 to transfer the measured tire to one or the other of the sixth conveyors 96 based upon the diameter of the measured tire. Toward this objective, the photoelectric cell device 45 and fluid cylinder device 41 are operatively associated with the programmed logic controller 108 which monitors the positions of and the sizes of the tires moving on the fifth conveyor 94. Thusly, for example, if two sequentially measured tires are of appropriate sizes to total the proper dimension to form a properly sized tire group, they will both be transferred to the same sixth conveyor 96, upon actuation of the fluid cylinder device 45 by the programmed logic controller 108, in preparation for movement through the rest of the system 310 to the destination as a group. However, for example, if sequentially measured tires are of sizes which when totalled or summed would form too large a tire group, one tire will be transferred to one of the sixth conveyors 96 and the other tire will be transferred to the other one of the sixth conveyors 96. Each tire will remain on the upstream conveyor section 98 of the sixth conveyor until a following tire, as measured by the photoelectric cell device 45, is of the proper dimension to form a properly sized tire group with that tire. The following tire will then be transferred to the proper sixth conveyor 96, as determined by the programmed logic controller 108, to join the tire already thereon to form a properly sized tire group in preparation for movement through the rest of the system 310 to the destination as a group.

Optionally, a scale can be located between the upstream conveyor section 98 and the downstream conveyor section 100 of the sixth conveyor 96 of each of the tire group accumulation stations 26 for weighing the group of accumulated tires transferred from the sixth conveyor 96 to the scale to accurately determine the weight of the tire group received from the upstream conveyor section 98. The weight information is then stored in the programmed logic controller 108.

The tire sorting and conveying system 310 also includes two tire group accumulation stations 32. Each tire group accumulation station 32 receives groups of tires from a different one of the tire accumulation stations 26. Further, similarly to the tire sorting and conveying system 210, each tire group accumulation station 32 includes two parallel accumulation conveyors 126A and 126B feeding to a single site or incenerator 16.

The downstream conveyor section 100 of the sixth conveyor 96 feeds directly to a tire group transport station 128A at the inlet end of the accumulation conveyors 126 of the tire group accumulation stations 32. The tire group transport stations 128A as shown as including tire group pusher means 212 at the downstream end of the downstream conveyor section 100 of the sixth conveyor 96 as previously described in relationship to the tire sorting and conveying system 210.

With continued reference to FIG. 8, it is further contemplated that the photoelectric cell 33 of the traffic control means 27, tire measuring means 43, and third tire measuring means 102 be eliminated and that the programmed logic controller 108 be used to continuously moditor the position of each measured tire being transported on the system 310 downstream of the tire ejection means 34 and to control the operation of all of the various components of the traffic control means 27, tire conveying station 24 including the tire transfer station 35, the tire accumulation station 26, tire group transport station 128A, and the tire group accumulation station 32. The sizes of the tires determined at the first measuring means 74 and second measuring means 76 and data on the location of each tire at the first and/or second measuring means would be stored in the programmed logic controller 108 as would the positions of the measured tires. Therefore, the programmed logic controller 108 can be used to control the operation of all of the components of the system 310 based upon the information received from the first 74 and second 76 measuring means and stored in the programmed logic controller 108.

The forgoing detailed description is given primarily for clearness of understanding and no unnecessary limitations are to be understood herefrom for modifications will become obvious to those skilled in the art upon reading this disclosure and may be made without departing from spirit of the invention or scope of the appended claims.

What is claimed is:

1. A system for sorting and conveying articles consisting of discarded tires and debris of various sizes from one site to at least one delivery site comprising:

means for receiving articles in bulk and dispensing articles therefrom;

conveyor means for receiving articles from the bulk receiving means and singularizing, separating the articles, and conveying the articles away from the bulk receiving means to the at least one delivery site;

means for measuring at least one dimension of the articles;

ejector means operatively associated with the measuring means for ejecting articles having a measured dimension outside a predetermined range;

means for accumulating the articles into groups of a predetermined size; and, means for controlling the discharge of article groups from the system to the at least one delivery site.

2. The system of claim 1, further comprising:

means for weighing each of the articles; and, the ejector means being operatively associated with the weighing means for ejecting articles having a weight outside of a predetermined range.

3. The system of claim 1, further comprising article group transfer means for selectively transferring groups of articles to selected ones of the at least one delivery site.

4. The system of claim 1, further comprising means for accumulating a number of article groups downstream of the article accumulating means and upstream of the at least one delivery site.

5. The system of claim 1, further comprising means for detecting foreign material included in or intermixed with the articles, the foreign material detecting means being operatively associated with the ejector means for ejecting articles including foreign material and foreign material intermixed with the articles.

6. The system of claim 1, wherein the foreign material detector means comprises metal detector means.

7. The system of claim 1, further comprising programmed logic control means operatively associated with the article measuring means and with the article ejector means for operating the ejector means in response to measurements received from the article measuring means.

8. The system of claim 1, further comprising programmed logic control means operatively associated with the article measuring means to receive article measurements and location data therefrom and for continuously monitoring the location of all of the articles on the conveyor means.

9. The system of claim 8, further comprising the programmed logic control means being operatively associated with the ejector means for actuating the ejector means when an article having a measured dimension outside of the predetermined range has been detected and is located at the ejector means.

10. The system of claim 8, further comprising the programmed logic control means being operatively associated with the conveyor means for controlling the conveying speed thereof.

11. The system of claim 8, further comprising the programmed logic control means being operatively associated with the article accumulation means for actuating the article accumulation means to form a group of articles of a predetermined size.

12. The system of claim 7, further comprising:

means for measuring the weight of each of the articles being conveyed on the conveyor means, the weight measuring means being operatively associated with the programmed logic control means; and, the logic control means being operatively associated with the conveyor means to increase and decrease the conveying rate based upon the weight of the articles being conveyed thereon.

13. The system of claim 1, wherein the article receiving means comprises a vibratory bulk bin for receiving articles in bulk, the bulk bin having an article discharge for discharging the articles therefrom.

14. The system of claim 13, wherein the conveyor means comprises a first conveyor for receiving articles from the vibratory bulk bin and singularizing, separating and conveying the articles away from the vibratory bulk bin.

15. The system of claim 14, wherein the conveyor means comprises:

a second conveyor for receiving articles from the first conveyor to further singularize and separate the articles and convey the articles; and the second conveyor operates at a higher conveying velocity than the first conveyor.

16. A system for sorting and conveying articles consisting of discarded tires and debris of various sizes from one site to at least one delivery site comprising:

an article receiving station for receiving a bulk supply of articles and dispensing the articles;

an article singularizing, orienting and separating station for receiving articles from the article receiving station, and singularizing, orienting, separating and conveying the articles;

an article sorting station for receiving articles from the article singularizing, orienting and separating station and sorting the articles based upon a predetermined physical characteristic, ejecting those articles which have a physical characteristic outside of a predetermined range;

an article accumulation station for receiving articles from the article singularizing, orienting and separating station for accumulating the articles into groups of articles based upon a physical characteristic of the articles; and, an article group accumulation station for receiving groups of articles from the article accumulation station and accumulating groups of articles prior to the discharge of the groups of articles from the system to the at least one delivery site.

17. A process for sorting and conveying articles consisting of discarded tires and debris of various sizes from one site to at least one delivery site comprising:

receiving a bulk supply of articles at one site;

singularizing, orienting and separating the articles from the bulk supply;

conveying the articles in a single line separated from adjacent articles away from the one site toward the delivery site;

measuring a predetermined physical characteristic of each article being conveyed;

ejecting those articles having a measured physical characteristic outside of a predetermined range;

accumulating the remaining articles into groups of articles based upon the measured physical characteristic of the articles making up a group of articles such that the sum of the physical characteristics of the articles of a group is within a predetermined range;

accumulating a plurality of groups of articles; and, discharging a selected article group from the accumulated groups of articles to the at least one delivery site.

18. The process of claim 17, further comprising selectively transferring groups of articles to selected ones of the at least one delivery site.

* * * * *